US009242338B2

(12) United States Patent
Lin et al.

(10) Patent No.: US 9,242,338 B2
(45) Date of Patent: Jan. 26, 2016

(54) CMP HEAD STRUCTURE

(71) Applicant: GLOBALFOUNDRIES Singapore Pte. Ltd., Singapore (SG)

(72) Inventors: Benfu Lin, Singapore (SG); Lei Wang, Singapore (SG); Xuesong Rao, Singapore (SG); Wei Lu, Singapore (SG); Alex See, Singapore (SG)

(73) Assignee: GLOBALFOUNDRIES Singapore Pte. Ltd., Singapore (SG)

( * ) Notice: Subject to any disclaimer, the term of this patent is extended or adjusted under 35 U.S.C. 154(b) by 0 days.

(21) Appl. No.: 14/059,448

(22) Filed: Oct. 22, 2013

(65) Prior Publication Data

US 2015/0111469 A1 Apr. 23, 2015

(51) Int. Cl.

| | |
|---|---|
| ***B24B 49/16*** | (2006.01) |
| ***B24B 37/005*** | (2012.01) |
| ***B24B 37/32*** | (2012.01) |

(52) U.S. Cl.

CPC ..... *B24B 37/005* (2013.01); *B24B 37/32* (2013.01); *B24B 49/16* (2013.01)

(58) Field of Classification Search

CPC .... B24B 7/228; B24B 37/005; B24B 37/042; B24B 37/32; B24B 49/16; B24B 51/00

See application file for complete search history.

(56) References Cited

U.S. PATENT DOCUMENTS

| | | | | |
|---|---|---|---|---|
| 6,390,908 | B1 * | 5/2002 | Chen et al. | 451/398 |
| 6,964,597 | B2 * | 11/2005 | Khuu | 451/5 |
| 9,017,138 | B2 * | 4/2015 | Chen et al. | 451/5 |
| 2007/0243796 | A1 * | 10/2007 | Torii | 451/5 |
| 2012/0021671 | A1 * | 1/2012 | McReynolds et al. | 451/6 |

* cited by examiner

*Primary Examiner* — Timothy V Eley

(74) *Attorney, Agent, or Firm* — Horizon IP Pte Ltd

(57) ABSTRACT

A CMP structure for CMP processing and a method of making a device using the same are presented. The apparatus comprises a polishing pad on a platen table, a head assembly for holding a wafer against the polishing pad, wherein the head assembly includes a retaining ring, a sensor for sensing the depth of grooves on the retaining ring and a controller for determining an update pressure to apply to the retaining ring based on the depth of the grooves and applying the updated pressure to the retaining ring during processing.

20 Claims, 6 Drawing Sheets

CMP HEAD STRUCTURE

BACKGROUND

The fabrication of ICs involves the formation of features on a substrate that make up circuit components, such as transistors, resistors and capacitors. The devices are interconnected, enabling the ICs to perform the desired functions. An important aspect of the manufacturing of ICs is the need to provide planar surfaces using chemical mechanical polishing (CMP).

CMP tools generally include a platen with a polishing pad. A wafer carrier including a polishing head is provided. The polishing head holds the wafer so that the wafer surface that is to be polished faces the polishing pad. During polishing, the polishing head presses the wafer surface against a rotating polishing pad. A retaining ring holds wafer in place by centering the wafer on the polishing pad and preventing the wafer from slipping laterally. During the CMP process, material is not only removed from the surface of the wafer to be planarized, but also from the polishing side surface of the retaining ring. This results in the decrease in the depth of grooves that are present on the side surface of the retaining ring, which could result in non-uniformity in the CMP process. As such, the retaining ring may need to be replaced frequently to maintain the desired uniformity.

As the polishing tool has to be taken offline when replacing the retaining ring, it could become quite costly to replace the retaining ring. Hence, there is a need for a CMP method and apparatus that could prolong the life of the retaining ring thereby reducing the cost of semiconductor processing.

SUMMARY

Embodiments generally relate to a CMP structure with an improved retaining ring life span for use in CMP and the use of such structure for forming semiconductor devices.

In one embodiment, the CMP structure comprises a polishing pad on a platen table; a head assembly for holding a wafer against the polishing pad, wherein the head assembly includes the retaining ring; a sensor for sensing the depth of grooves on the retaining ring and a controller for determining an update pressure to apply to the retaining ring based on the depth of the grooves and applying the updated pressure to the retaining ring during processing.

In another embodiment, a method for prolong the use of a retaining ring comprises providing a head assembly for use in polishing a wafer, wherein the head assembly includes a retaining ring for holding the wafer in place on a polishing pad; determining the depth of grooves on the retaining ring; calculating an updated pressure to be applied to the retaining ring based on the depth of the grooves and applying the updated pressure to the retaining ring during processing.

In yet another embodiment, a method for making a device comprises providing a wafer and processing the wafer, wherein the wafer is processed by providing a head assembly for use in polishing the wafer; wherein the head assembly includes a retaining ring for holding the wafer in place on a polishing pad; determining the depth of grooves on the retaining ring; calculating an updated pressure to be applied to the retaining ring based on the depth of the grooves and applying the updated pressure to the retaining ring during processing.

These advantages and features of the embodiments herein disclosed will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles. Various embodiments are described with reference to the following drawings, in which.

DESCRIPTION

Figure 1:
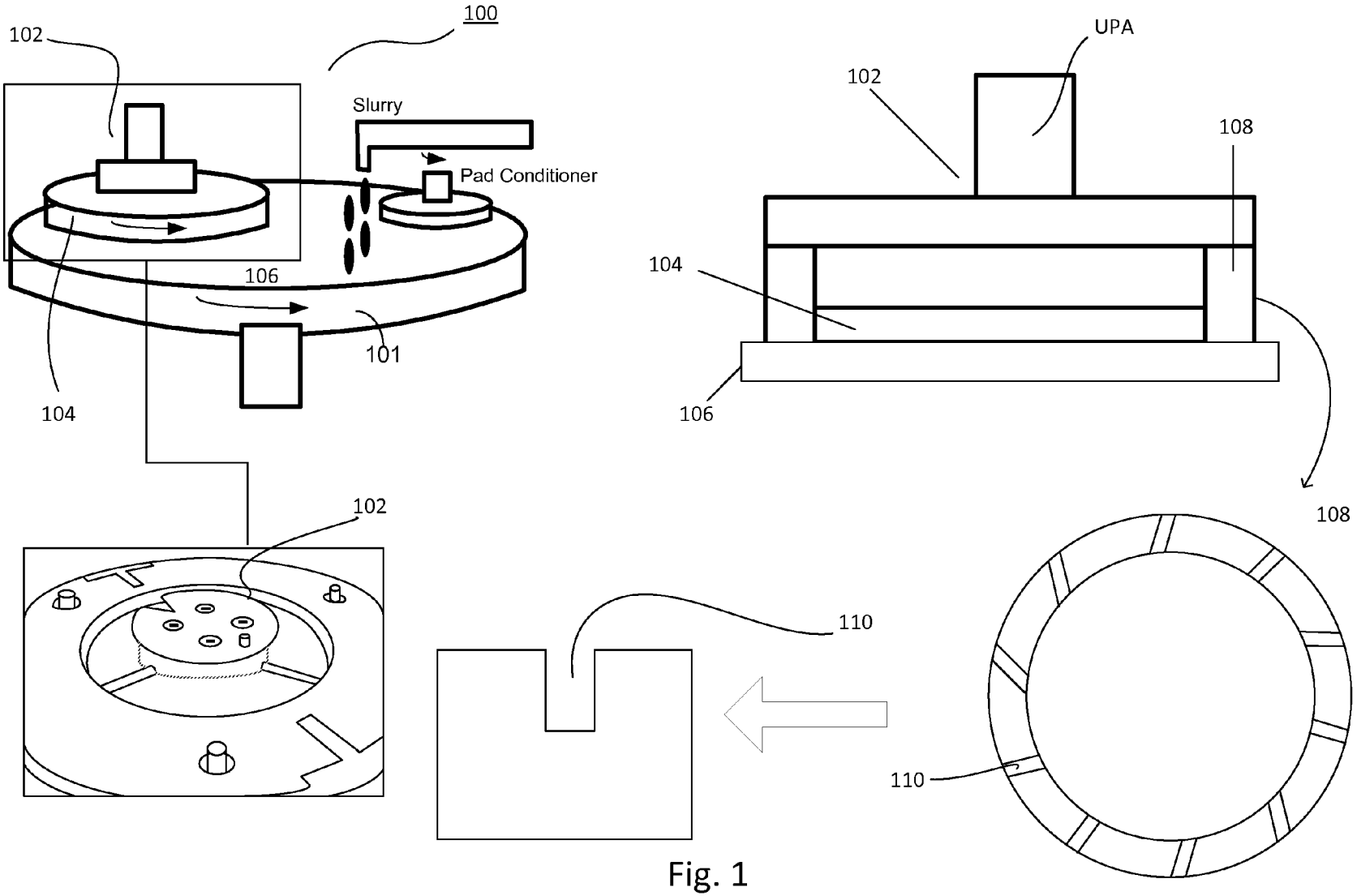
FIG. 1 shows side, top and cross-sectional views of an embodiment of a CMP structure.

Embodiments generally relate to CMP. FIG. 1 shows side, top and cross-sectional views of an embodiment of a CMP structure. The top left diagram in FIG. 1 shows a CMP structure 100 with a polishing pad 106 on a platen table 101, and a head assembly 102 holding a wafer 104 against the polishing pad with the wafer surface that is to be polished facing the polishing pad. During polishing, polishing head 102 presses the wafer 104 against the polishing pad while a retaining ring (not shown in this view) holds the wafer 104 in place by centering the wafer 104 on the polishing pad and preventing the wafer from slipping laterally. The diagram directly below the top left diagram shows a top view of head structure 102. As this view shows the backside of head structure 102, the retaining ring is also not visible.

Referring to the diagram on the top right of FIG. 1, a cross-sectional view of the CMP head structure is shown. Here, retaining ring 108 can be seen and as shown, during the CMP process, material is not only removed from the surface of the wafer planarized, but also from the side surface of the retaining ring 108. A top view of retaining ring 108 is shown below the cross-sectional view at the top right corner. As can be seen, retaining ring 108 includes grooves 110, which are used for flowing in slurry and flowing out by products during CMP.

Figure 2:
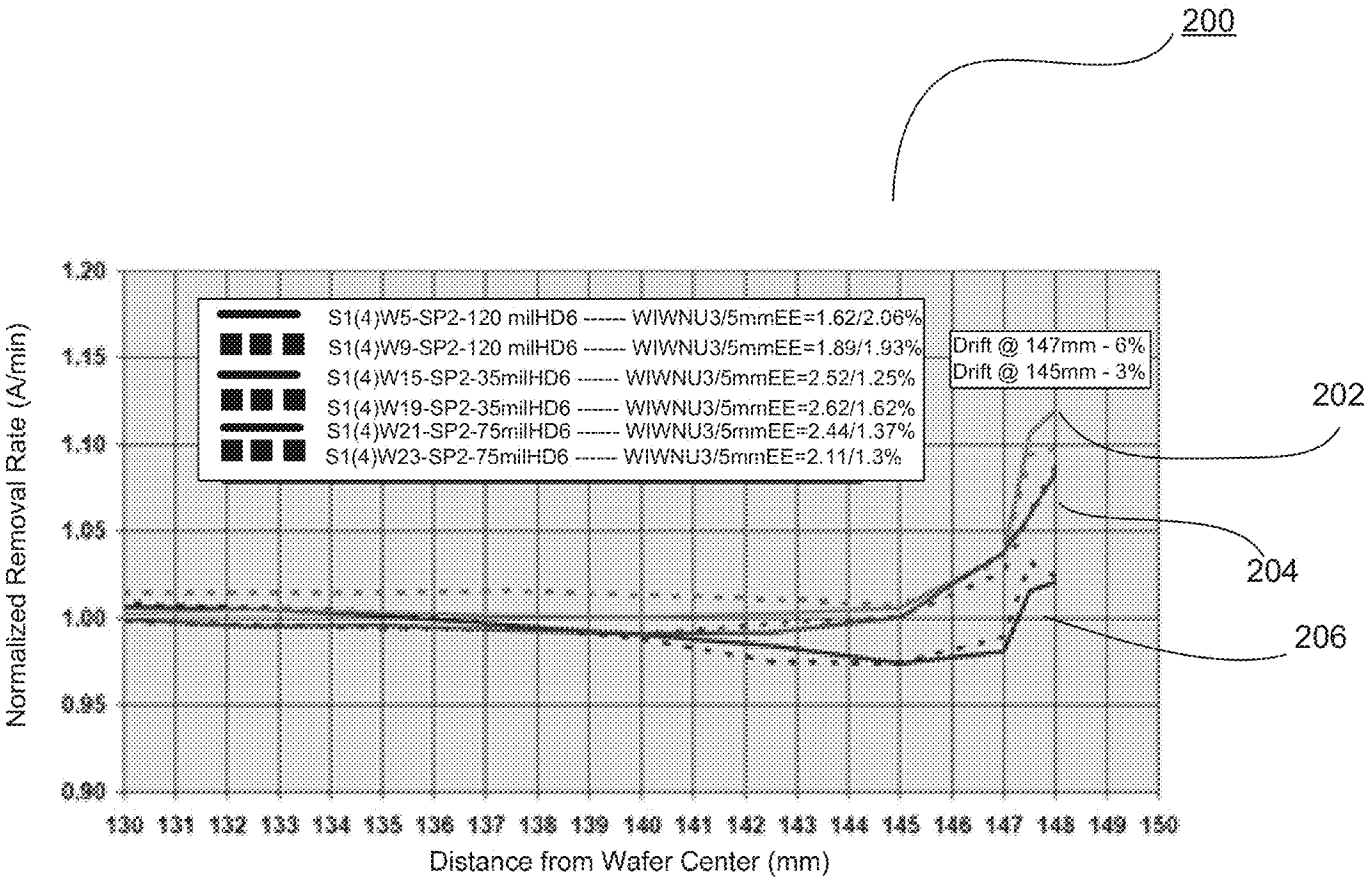
FIG. 2 shows a graph that illustrates the edge rate drift over the life of a retaining ring.

In view of the fact that retaining ring 108 material is also removed as wafer 104 is being polished, the retaining ring grooves 110 get worn out during the CMP process, thereby resulting in wafer edge profile change. Referring to FIG. 2, a graph 200 that illustrates the edge rate drift over the life of a retaining ring may be seen. A blank wafer is used in this study which measures the normalized removal rate of the wafer radius starting from about 130 mm from the center of the wafer to about 148 mm from the center of the wafer using an old retaining ring, a medium aged retaining ring and a new retaining ring. The old retaining ring may have a groove depth of about 35 mm, whereas the new retaining ring may have a groove depth of about 120 mm. The groove depth of the medium aged retaining ring may be any number roughly in between 35 mm to 120 mm.

The removal rate of the old retaining ring is shown by line 202; the removal rate of the medium aged retaining ring is shown by line 204; while the removal rate of the new retaining ring is shown by line 206. As can be seen, the difference of the removal rates of all 3 lines are fairly uniform initially, but as the distance from the center of the wafer approaches about 140 mm, the difference starts to widen and by about 145 mm from the center of the wafer, the drift is about 3 percent, whereas by about 147 mm from the center of the wafer, the drift is about 6 percent. Hence, there is a 6 percent increase in the normalized removal rate of the retaining ring as a new ring wears out and become old.

Figure 3:
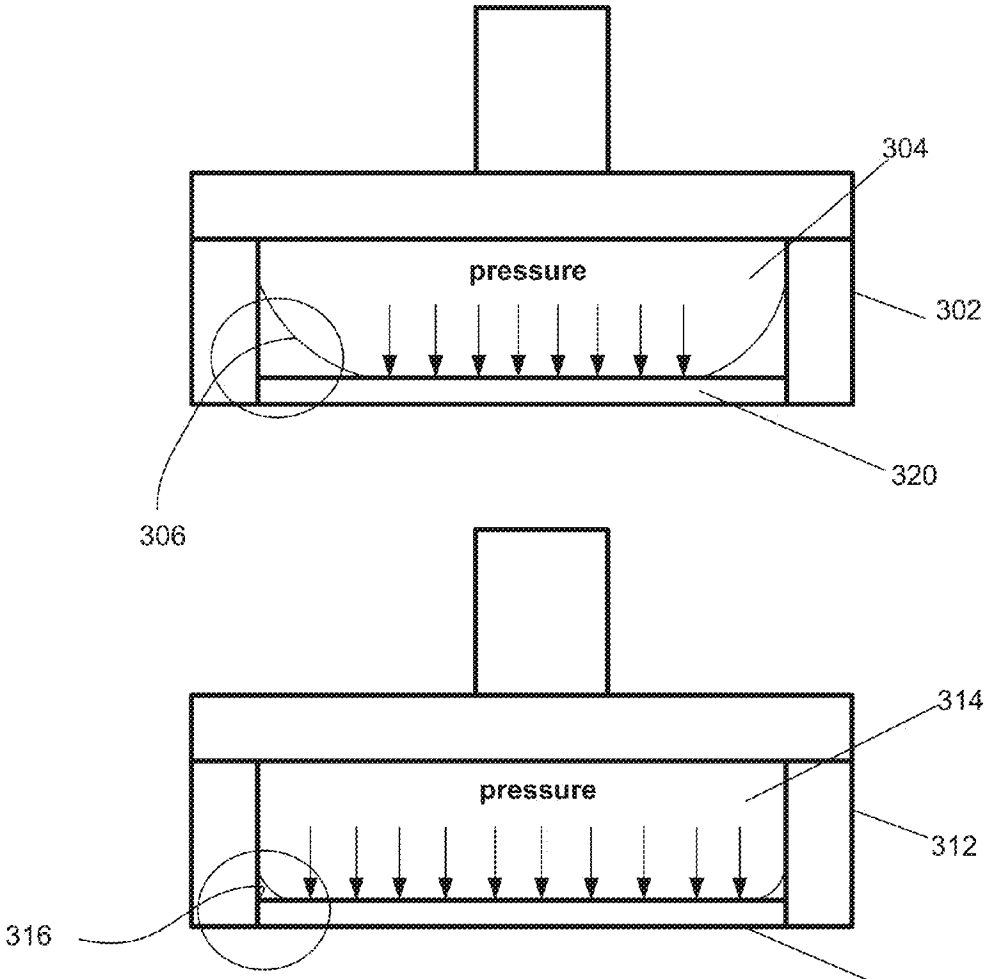
FIG. 3 shows a cross-sectional view of a new and old retaining ring, respectively.

FIG. 3 shows a cross-sectional view of a new and old retaining ring, respectively. As shown, the new retaining ring 302 has a corresponding membrane 304 that exerts pressure on wafer 320, while old retaining ring 312 has a corresponding membrane 314 that exerts pressure on wafer 320. As can be seen, the gap 306 between the membrane 304 and side of the new retaining ring 302 is larger than the gap 316 between the membrane 314 and side of the old retaining ring 312 As the gaps 306 and 316 correlate to the depth of the grooves on the retaining ring, this figure confirms that a new retaining ring has deeper groove depth than an old retaining ring and that as the ring wears, the groove depth of the retaining ring becomes shallower. This results in the edge of the membrane being located closer and closer to wafer 320 and the tension exerted on the wafer eventually becomes compressive when inflated, which effectively leads to a higher down force towards the edge of the wafer as the retaining ring ages.

Figure 4:
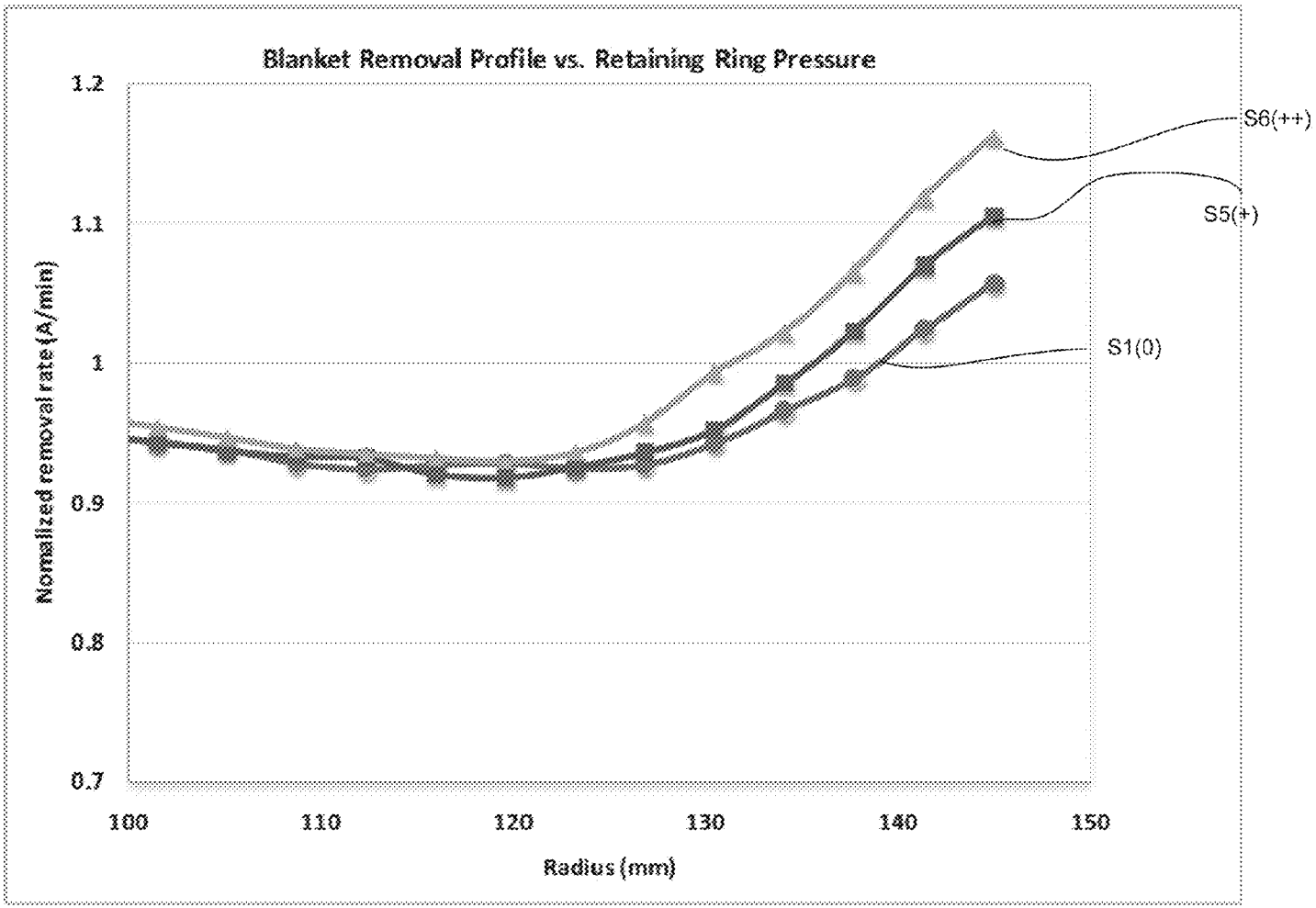
FIG. 4 shows a graph that illustrates the blanket rate profile versus the retaining ring pressure.

FIG. 4 shows a graph that illustrates the blanket normalized removal rate profile versus the retaining ring pressure. Referring to FIG. 4, line S1(0) signifies the initial pressure exerted by a retaining ring. Line S5(+) signifies the pressure of line S1(0) increased by 1 unit. As can be seen, the removal rate of line S5(+) at the edge of the wafer is higher as compared to line S1(0). Line S6(++), which signifies the pressure of line S1(0) increased by 2 units, has the highest removal rate at the edge of the wafer. As can be seen, the wafer edge profile is affected significantly by the changing retaining ring pressure. As such, as the retaining ring ages, it is possible to compensate for the aging of the retaining ring by adjusting the pressure applied by the retaining ring.

Figure 5A:
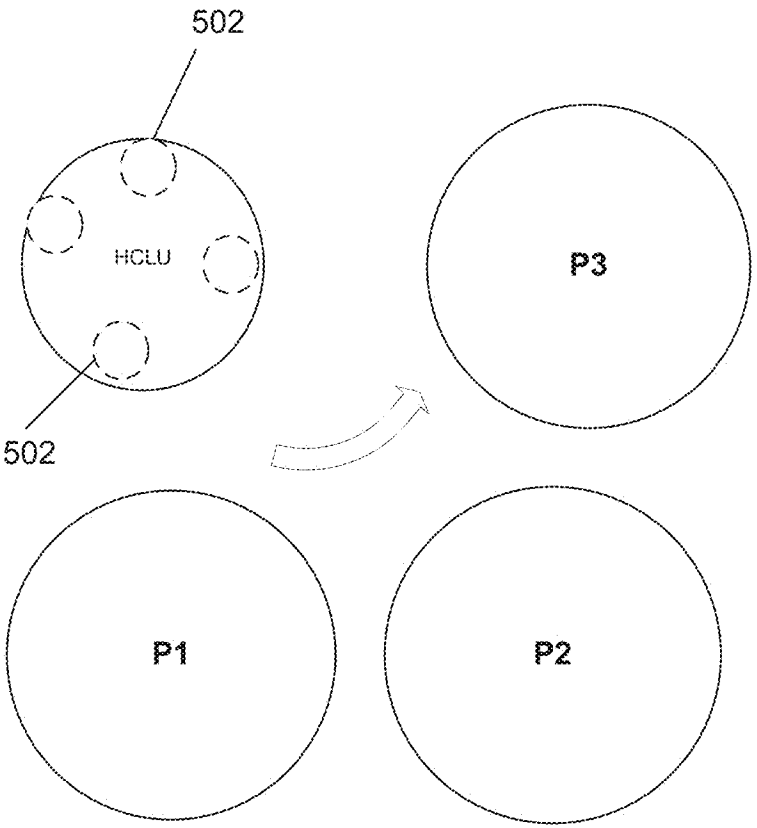
FIGS. 5(*a*)-5(*b*) show a method for monitoring the groove depth of a retaining ring and adjusting the pressure applied to the retaining ring to compensate for the aging/wearing out of a retaining ring.
Figure 5B:
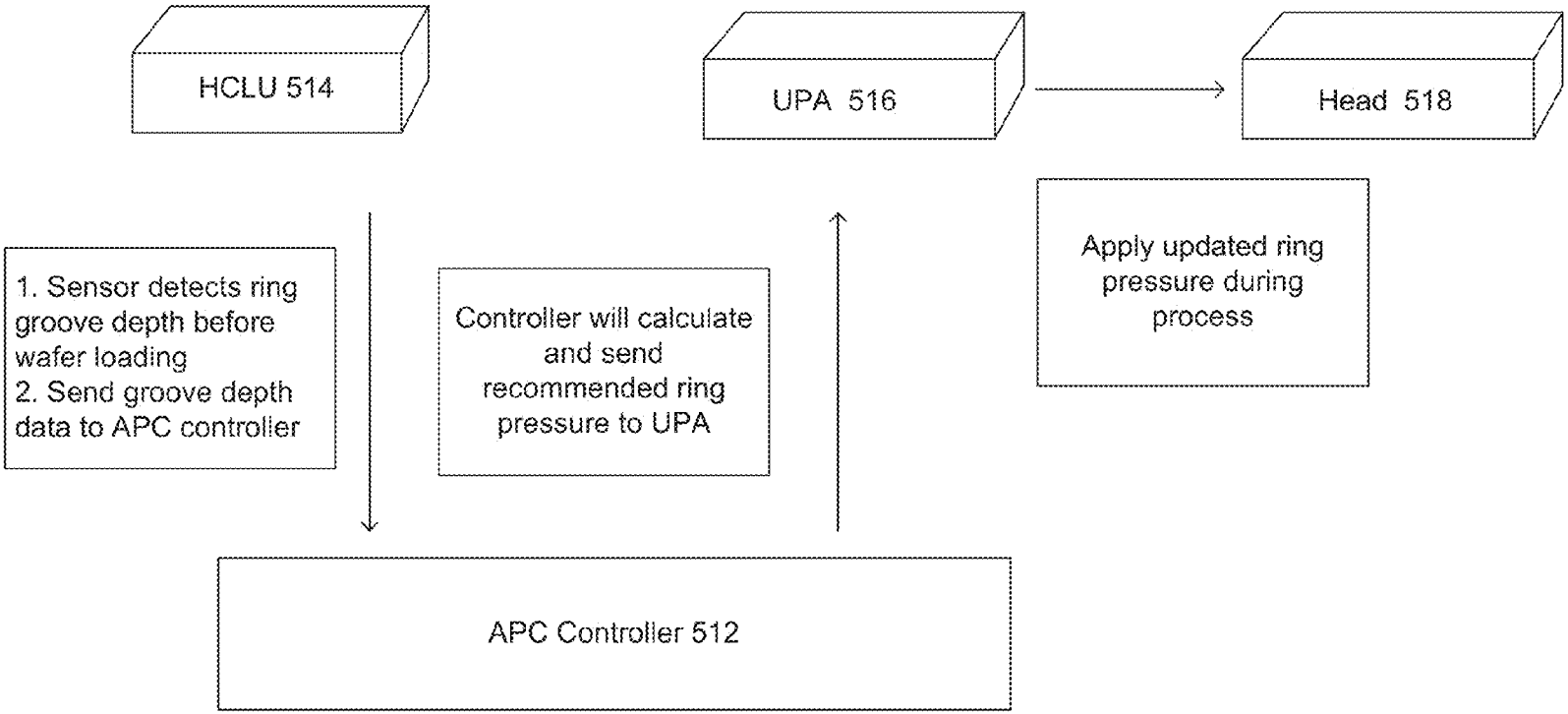

FIGS. 5(*a*)-5(*b*) show a method for monitoring the groove depth of a retaining ring and adjusting the pressure applied to the retaining ring to compensate for the aging/wearing out of a retaining ring. Referring to FIG. 5(*a*), one or more sensors 502 may be installed at a head cup load unload (HCLU) to measure the groove depth of the retaining ring before loading a wafer. The groove depth may be measured before each wafer or a batch of wafers being processed through standard CMP equipment, which is depicted by P1, P2 and P3 in FIG. 5(*a*). The batch of wafers may have 50 wafers in a batch or 100 wafers in a batch. In other embodiments, the batch may include other numbers of wafers in a batch. In another embodiment, the groove depth of the retaining ring may be measured after each wafer is processed or it may be measured after a batch of wafers has been processed.

Referring to FIG. 5(*b*), an advance process controller (APC) 512 may be set up to monitor the groove depth and control the pressure exerted by the retaining ring. As shown, the APC 512 receives the measurement of the groove depths from HCLU 514 in the form of a digital signal. APC512 will calculate ring pressure based on groove depth data received and send recommended ring pressure data to the upper pneumatic-assembly UPA 516.

UPA 516 will then supply the updated pressure data (from APC 512) to the head assembly 518 for head assembly 518 to apply the updated pressure to the retaining ring during processing. The updated pressure applied by head assembly 518 to the retaining ring will become less and less as the retaining ring ages to compensate for the higher pressure exerted by the old retaining ring. The calculation by APC 512 may be based on a model, and the model can be monitored and revised based on inline performance.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A method for prolonging the use of a retaining ring comprising:

providing a head assembly for use in a process for polishing a wafer, wherein the head assembly includes a retaining ring for holding the wafer in place on a polishing pad;

determining a depth of grooves on the retaining ring based on a gap between a membrane of the retaining ring and a side of the retaining ring which correlates to the depth of the grooves;

calculating an updated pressure to be applied to the retaining ring based on the depth of the grooves; and applying the updated pressure to the retaining ring during the process.

2. The method of claim 1 wherein the updated pressure applied to the retaining ring during the process will become less as the depth of grooves on the retaining ring becomes shallower.

3. The method of claim 1 wherein the updated pressure applied to the retaining ring during the process will become less as the depth of the grooves on the retaining ring decreases.

4. The method of claim 1 wherein the depth of the grooves on the retaining ring are determined by one or more sensors installed at a head cup load unload (HCLU).

5. The method of claim 4 wherein a process controller will calculate an updated pressure based on the depth of grooves data received from the one or more sensors at the HCLU and send the updated pressure to an upper pneumatic assembly (UPA).

6. The method of claim 1 wherein the updated pressure to be applied to the retaining ring based on the depth of the grooves is calculated by a process controller.

7. The method of claim 6 wherein an upper pneumatic-assembly (UPA) will supply the updated pressure calculated by the process controller to the head assembly and the head assembly will apply the updated pressure to the retaining ring during the process.

8. The method of claim 6 wherein the calculation by the process controller is based on a model and the model may be monitored and revised periodically based on inline performance.

9. A method for forming a device comprising:

providing a wafer; and processing the wafer, wherein the wafer is processed by providing a head assembly for use in polishing the wafer, wherein the head assembly includes a retaining ring for holding the wafer in place on a polishing pad;

determining a depth of grooves on the retaining ring based on a gap between a membrane of the retaining ring and a side of the retaining ring which correlates to the depth of the grooves, and calculating an updated pressure to be applied to the retaining ring based on the depth of the grooves, and applying the updated pressure to the retaining ring during processing.

10. The method of claim 9 wherein the updated pressure applied to the retaining ring during processing will become less as the depth of the grooves on the retaining ring decreases.

11. The method of claim 9 wherein the updated pressure applied to the retaining ring during processing will become less as the depth of the grooves on the retaining ring becomes shallower.

12. The method of claim 9 wherein the depth of the grooves on the retaining ring are determined by one or more sensors installed at a head cup load unload (HCLU).

13. The method of claim 9 wherein the updated pressure is calculated by a controller based on the depth of the grooves.

14. The method of claim 13 wherein the controller comprises a process controller configured for monitoring the groove depth and controlling the pressure exerted by the retaining ring.

15. The method of claim 14 wherein the process controller receives measurement of the groove depth from one or more sensors in the form of a digital signal.

16. The method of claim 15 wherein the process controller calculates the updated pressure based on groove depth measurement received from the one or more sensors and sends the updated pressure to an upper pneumatic assembly (UPA).

17. The method of claim 16 wherein the UPA supplies the updated pressure to the head assembly.

18. The method of claim 17 wherein the head assembly applies the updated pressure to the retaining ring during processing.

19. The method of claim 13 wherein the calculation by the controller is based on a model and the model can be monitored and revised periodically based on inline performance.

20. The method of claim 13 wherein the controller calculates and sends a lesser recommended ring pressure data to an UPA if the groove depth data received by the controller from one or more sensors indicate that the groove depth has decreased.

* * * * *